US005179149A

United States Patent [19]

Höver et al.

[11] Patent Number: 5,179,149

[45] Date of Patent: Jan. 12, 1993

[54] PROCESS FOR MANUFACTURING NONWOVEN MATERIALS SUCH AS FLOOR OR WALL DOVERINGS, IN PARTICULAR FROM NATURAL OILS

[75] Inventors: Alexander Höver; Jakob Lapp, both of Troisdorf; Manfred Simon, Niederkassel; Karl-Heinz Spiess, Much; Wilhelm Zündorf, Troisdorf-Müllekoven, all of Fed. Rep. of Germany

[73] Assignee: Huels Troisdorf AG, Troisdorf, Fed. Rep. of Germany

[21] Appl. No.: 689,070

[22] PCT Filed: Dec. 20, 1989

[86] PCT No.: PCT/EP89/01571

§ 371 Date: Jun. 20, 1991

§ 102(e) Date: Jun. 20, 1991

[87] PCT Pub. No.: WO90/07607

PCT Pub. Date: Jul. 12, 1990

[30] Foreign Application Priority Data

Dec. 23, 1988 [DE] Fed. Rep. of Germany ..... 3843482

[51] Int. Cl.[5] ..... C08L 91/00; C08K 5/14; C08J 3/24

[52] U.S. Cl. ..... 524/310; 524/313; 524/322; 524/914; 525/301.5

[58] Field of Search ..... 524/310, 322, 914; 525/301.5

[56] References Cited

U.S. PATENT DOCUMENTS

| | | | |
|---|---|---|---|
| 2,162,924 | 6/1939 | Spitzili et al. | 524/13 |
| 2,330,798 | 11/1939 | Chittick et al. | 525/301.5 |
| 3,873,584 | 3/1975 | Burke, Jr. et al. | 260/407 |
| 3,875,091 | 4/1975 | Tsugukuni et al. | 524/310 |
| 3,952,023 | 4/1976 | Kaiya et al. | 525/301 |
| 4,093,583 | 6/1978 | Apotheker | 525/387 |

FOREIGN PATENT DOCUMENTS

| | | | |
|---|---|---|---|
| 58318 | 6/1890 | Fed. Rep. of Germany . | |
| 9777 | 5/1955 | Fed. Rep. of Germany . | |
| 1022007 | 1/1958 | Fed. Rep. of Germany . | |
| 1223048 | 3/1986 | Japan | 524/322 |
| 18825 | of 1913 | United Kingdom . | |

OTHER PUBLICATIONS

German Publication by Ullmann, 4th Edition, vol. 12, p. 23 ff.

*Primary Examiner*—Paul R. Michl
*Assistant Examiner*—Andrew E. C. Merriam
*Attorney, Agent, or Firm*—Millen, White, Zelano and Branigan

[57] ABSTRACT

A process for manufacturing nonwoven materials such as floor or wall coverings from natural or synthetic oils and natural or synthetic elastomers is carried out in two reaction phases. In the first reaction phase, a mixture of a stand oil or an equivalent synthetic polymer oil is homogenized with fillers and partially polymerized and partially crosslinked at high temperature to form an intermediate product I. The ground intermediate product I is then homogenized with a natural or synthetic elastomer, in particular natural rubber, fillers and a peroxide and crosslinked and polymerized at a high temperature. The process is suitable for manufacturing homogeneous and possibly marbled floor coverings based on natural materials and processing outstanding physical and optical properties.

12 Claims, No Drawings

PROCESS FOR MANUFACTURING NONWOVEN MATERIALS SUCH AS FLOOR OR WALL DOVERINGS, IN PARTICULAR FROM NATURAL OILS

TECHNICAL FIELD

The invention relates to a process for the production of nonwoven materials such as floor or wall coverings, especially for the production of multicolored structured floor coverings and with broad use of natural initial materials. In this case, there are distinguished homogeneous coverings, which in their overall thickness exhibit the same formulation composition, and combination coverings, which consist of a combination of a wear-resistant upper useful layer and a, e.g., textile underlayer. For the quality of a floor coverings physical properties such as elasticity (flexural behavior) and abrasion resistance as just as essential as optical properties (pattern possibilities) and physiological harmlessness as well as "environmentally neutral" waste disposal.

PRIOR ART

The useful layers of known synthetic floor coverings in most cases consist of a mixture of fillers and binders, and especially PVC containing plasticizers, which have been generally accepted as binders (Ullmann, 4th edition, vol. 12, p. 23 ff). Especially homogeneous PVC coverings exhibit superior functional properties such as high abrasion resistance, good elasticity, little tendency to brittle failure, excellent bonding properties and weldability and in addition varied pattern possibilities. But because of the plasticizer and chlorine content PVC coverings are subjected to increasing criticism.

A floor covering which is produced from largely natural materials is linoleum. The process, which was developed a 100 years ago, so far has not substantially changed. Linseed oil or other oils such as rapeseed oil, colza oil, soybean oil, fish oil or tung oil, etc. in the presence of drying agents in the form of cobalt, manganese, lead and zinc compounds and of air is heated over a prolonged period of 10 or even more hours to a temperature between 100° and 200° C. and the linoxyn thus formed, with the addition of resins such as rosin and organic fillers such as cork flour and wood flour again at increased temperature over several hours is further oxidized to linoleum cement. The further processing of the linoleum cement by a calender and backing with a jute fabric is then followed by a protracted autoxidation process in constant temperature chambers at 60° to 70° and for 10 to 14 days. The process is very time-consuming, despite the use of process-accelerating heavy metal compounds.

Acceleration of the oxidation process of boiled linseed oil by oxygen-cleaving agents such as chlorinated lime, chromic acid or the like is known from DE-A-58 318. The use of these oxidizing agents is problematic for industrial use and leads to unsuitable products so that this process has not been put into practice.

Despite the extensive use of natural materials, linoleum is problematic in waste disposal because of the portion of heavy metals (0.5 to 2% by weight). Moreover, the physical properties such as elasticity, abrasion resistance and elongation at break are far inferior to those of the PVC covering. The brittleness of linoleum does not allow its processing to homogeneous coverings. Moreover, linoleum coverings cannot be produced in the variety of patterns as typical of PVC coverings.

OBJECT OF THE INVENTION

The object of the invention is to make available a process for the production of nonwoven materials such as floor or wall coverings that without the use of heavy metal or halogen compounds leads to coverings with high elasticity and elongation at break, little brittleness, good abrasion resistance and varied pattern possibilities. Especially the process is to make possible the extensive use of naturally obtained raw materials, without being dependent on a time-consuming process as is the case in linoleum production.

DESCRIPTION OF THE INVENTION

The invention achieves this object by the following process steps:

A mixture containing a) 20 to 40% by weight of one or more oils of the group
   - $a_1$) stand oil from natural oils such as linseed oil, tung oil, soybean oil or other natural oils or their mixtures,
   - $a_2$) polymer synthetic or natural oil with an average molecular weight between 500 and 7000, a dynamic viscosity (20° C.) of greater than 0.5 [Pa.s] and an iodine number (Wijs) greater than 200 [g/100 g], b) 50 to 75% by weight of fillers and c) a peroxide is processed at a temperature of 200° to 280° C. to a partial polymerized and partially crosslinked intermediate product I in the form of a granular material or grinding stock, which then, optionally, with further addition of binders and additives, is further processed to the nonwoven materials.

The invention starts from pretreated (pre)polymerized natural oils of high viscosity, especially stand oil from linseed oil or a mixture of linseed oil and tung oil with a viscosity of 10 to 100 [Pa.s] at 20° C.) and/or appropriate synthetic oils, and the latter preferably exhibit a molecular weight of 500 to 7000, a dynamic viscosity of more than 0.5 [Pa.s] at 20° C. and a iodine number (Wijs) greater than 200 [g/100 g].

The unsaturated initial oils are mixed in a first process step with fillers, a peroxide and optionally pigments to a paste and reacted to an intermediate product I at a temperature of about 200° to 280° C., and the oils are (further) polymerized and (partially) cross inked.

Organic or inorganic granular or fibrous materials are used as fillers. Cork flour, wood flour, coconut fibers or cotton fibers as well as starch are preferred as organic fillers, chalk, kaolin and pumice flour as inorganic fillers.

Organic peroxides are preferably used as peroxides, especially the peroxides mentioned in the following table are preferred:

| Peroxide | Decomposition temperature (°C.)* |
|---|---|
| n-butyl-4,4'-bis-(t-butylperoxi) valerate | 140 to 160 |
| 1,1-bis(t-butylperoxi)-3,5,5-trimethyl-cyclohexane (Luperox 231) | 135 to 180 |
| bis-(2 t-butylperoxi-isopropyl)-benzene (Luperco 802) | 170 to 210 |
| d,d'-bis (t-butylperoxi)-m/p-diiso-propylbenzene | 140 to 185 |
| t-butyl-per-3,5,5-trimethyl-hexanoates | 150 to 190 |

-continued

| Peroxide | Decomposition temperature (°C.)* |
|---|---|
| (Luperox 270) | |
| di-(isopropylbenzyl)-peroxide (Luperco 540) | 160 to 205 |
| tert-butyl-per-ethylhexanoates (Luperco 26 R) | 100 to 140 |
| tert-butylperbenzoate (Luperox P) | 130 to 175 |
| 2,5-dimethyl-2,5-bis- (t-butylperoxi)-hexane (Luperox 101) | 170 to 210 |
| 2,5-dimethyl-2,5-di (t-butylperoxi)-hexyne-3 (Luperox 130) | 180 to 240 |
| ethyl-3,3-bis-(t-butylperoxi)butyrate (Luperco 233) | 155 to 200 |
| di-tert-butylperoxide (Trigonox B) | 180 to 240 |
| benzoylperoxide (Luperco AST) | 150 |
| di-benzoylperoxide (Lucidol) | 120 to 150 |
| di-lauroylperoxide (Interox) | 80 to 120 |

(*recommended crosslinking temperature of the producer)

Surprisingly it has turned out that the reaction temperature in the first process step has to be substantially above the decomposition temperature of the peroxide, preferably by 20° to 130° C.

The pasty mixture of filler, oils and peroxide can be applied, for example, in 2 to 5 mm thickness on a Teflon belt by a doctor knife and continuously reacted in a heating channel for a period of 2½ to 3 hours at 250° C. The reaction (compound) temperatures preferably are 20° to 130° C. above the decomposition temperatures of the individual peroxides.

The cake solidified according to the reaction conditions can be ground, after cooling, to intermediate product I and then appropriately further processed.

The processing can be performed just as well after mixing of the components, for example, in an Eirich mixer or in a kneader for 30 to 50 minutes and at a temperature of 210° to 220° C. Thus a free-flowing intermediate product I is obtained.

The polymerization or partial crosslinking can also be performed in 40 to 60 minute at 210° C. on a roller.

This process can also take place continuously on a so-called shearing rolling mill at compound temperatures between 230° and 250° C. A shearing rolling mill is an open twin-screw extruder with two externally accessible shaped shearing rollers working in opposite directions. The premixed material is continuously fed into the roller nip, while the reaction product is just as continuously processed to a uniform granular material by an attached granulating unit. A closed twin-screw extruder can also be used. The chemical process is exothermic, i.e., heat is released. The product has to be cooled after the reaction. This can take place with air, but also with water. In the performance of the first process step (production of intermediate product I) attention is to be given especially in using closed devices (kneader, closed twin-screw extruder) to a precise temperature control (temperature regulation) to avoid an overheating of the intermediate product.

In the prepolymerization process of the natural oils with peroxides accelerators and flexibilizing components such as acrylates, HDDA (hexanediol diacrylate), citric acid, wool fat, terpenes can be added. The addition of the peroxides provides the condition for the rapid reactivity of this system. The processing of the natural oils such as linseed oil, soybean oil, rapeseed oil, fish oil or tung oil or also their reaction products with air leads to blown oils, in contrast to the previously known natural oils used according to the invention, under the above listed conditions does not lead to any dry prepolymerization. The products remain viscous or sticky.

In the simplest case, intermediate product I, obtained as above, like linoleum cement in the linoleum process, can be further processed and backed with jute fabric. Thus products are obtained—also with working in of a jute fabric—which exhibit a brittleness like linoleum. But in contrast with linoleum, this product exhibits no heavy metals whatsoever, also the production process is shortened.

Surprisingly it has been found that granulated or grained intermediate product I, produced according to the invention, and consisting essentially of prepolymerized and partially crosslinked oil and filler, by addition of elastomers, especially natural rubber, other fillers as well as a crosslinking agent, especially peroxide, can be further processed to flexible products, which in their properties are substantially superior to those of linoleum.

For this purpose, intermediate product I is mixed with an elastomer such as synthetic or natural rubber and/or synthetic or natural rubber latex, organic or inorganic fillers, a crosslinking agent as well as optionally pigments (dye) and is further crosslinked or polymerized (2nd process step) at increased temperature. Reinforcing properties can also be achieved by addition of polyolefins.

Preferably a mixture containing a) 5 to 70% by weight of intermediate product I
b) 5 to 60% by weight of an natural or synthetic elastomer, such as natural rubber latex, synthetic rubber latex, natural rubber, synthetic rubber, EPM, EPDM,
c) 10 to 70% by weight of filler,
d) 0.5 to 7% by weight of one or more crosslinking agents from the group
   $d_1$) sulfur-containing crosslinking agent
   $d_2$) peroxide is mixed and crosslinked or polymerized at increased temperature.

For one thing, the natural rubber latices such as Kagetex, Revertex and Revultex in combination with the prepolymerized oils and fillers such as chalk, kaolin as well as preferably peroxides as crosslinking agents and dyes are applied with a doctor knife as paste on an endless belt or a jute fabric according to spread coating—and the water can evaporate in the heating channel and the final polymerization proceeds, optionally the surface can be needle-punched for better evaporation of the water and the web fabric is embossed on the surface with an embossing rolling mill and then crosslinked.

The specified paste can also be processed on a roller or a shearing rolling mill at temperatures between 100° and 140° C., and the rolled strip is pressed into sheets at 140° C. and can be crosslinked, while the granular material obtained from the shearing rolling mill can be processed by one or more extruders in different colors also continuously by a twin belt press or a knurled rolling mill with subsequent embossing and crosslinking to a colored marbled floor covering. Instead of rubber latices, crude rubber in solid form can also be used, and the balls are cut and ground and the dry mixture produced from it together with other additives can be further processed by extruder, rolling mill, shearing rolling mill, etc.

The crosslinking in the 2nd process step preferably takes place with peroxides, and the temperature of the compound optionally can be even below the crosslinking temperature recommended by the producer.

Optionally sulfur compounds can also be used as crosslinking agents in the 2nd process step.

METHODS FOR EMBODYING THE INVENTION

Example 1

A mixture of 1a) 24.9% by weight of linseed oil-stand oil (viscosity 80 [Pa.s], Vereinigte Uerdinger Oelwerke company, trade name: Leinoel-Standoel 800),
1.25% by weight of wool fat,
0.5% by weight of peroxide 2,5-dimethyl-2,5-di-(t-butylperoxi)-hexane ((Luperox 101, Luperox GmbH, Gruenzburg),
1% by weight of wood flour (C 120 F, Cellulose-Fuellstoff-Fabrik, Moenchengladbach)
2% by weight of dipentene,
1.6% by weight of citric acid,
67.75% by weight of chalk (Juraperle MHM, Ulmer Fuellstoff Vertrieb),
1% by weight of red dye is put into a planetary stirrer and homogenized to a paste within 5 minutes and applied with a doctor knife in 2.2 mm thickness on an endless teflon belt and heated in a heating channel 4 m long to a temperature of 255° C. at a rate of 0.15 m/min. The dry material that had come from the channel was cooled and then broken into pieces and ground (screen size 1 mm) to intermediate product I.

Ground intermediate product I (Ia) was mixed according to the following formulation to a pasty compound with other additives:

1b) 20% by weight of 1a)
49% by weight of rubber latex (Kagetex FA 60%, Kautschuk Gesellschaft, Frankfurt)
2% by weight of vulcanization auxiliary agent (Suplon 182 T, Synthomer Chem. company),
2% by weight of wood flour (C 120 F),
25% by weight of kaolin (RC 32 K, Sachtleben Chemie GmbH),
2% by weight of sulfur vulcanization agent (MC 12 V, Synthomer GmbH, Frankfurt).

The spreadable paste was applied by a doctor knife on a jute fabric in a thickness of 3 mm, dried for 20 minutes at 150° C., continuously perforated with a needle roller and heated for another 20 minutes in a channel to 150° C.

The web fabric thus produced was punched and pressed at 150° C., 100 bars, for 5 minutes.

An elastic fabric-reinforced nonwoven material resulted.

Example 2

A mixture of 2a) 29.3% by weight of tung oil-linseed oil-stand oil (Holzoel-Leinoel-Standoel 90/10, Vereinigte Uerdinger Oelwerke),
0.66% by weight of leveling agent (Byk 2600, Byk Chemie company, Wesel),
0.44% by weight of leveling agent (Bentone LT, Kronos Titan GmbH),
1.8% by weight of citric acid,
1.8% by of starch (Spezialstaerke 03430, Maizena, Hamburg),
36.50% by weight of chalk (Juraperle MHM, Ulmer Fuellstoff-Vertrieb),
27.40% by weight of kaolin (RC 32 K, Sachtleben Chemie, Frankfurt),
1.2% by weight of peroxide (Percadox 14-90 k, Akzo Chemie)
0.9% by weight of yellow dye was applied, according to example 1, in 4 mm thickness to an endless belt and reacted in a 4-m long heating channel at 245° C. and at a rate of 0.05 m/min and then comminuted. Intermediate product I, thus prepared, was processed within 5 minutes in a mixing dissolver with the following additives to a spreadable paste:

2b)
12.7% by weight of intermediate product I from 2a),
38.1% by weight of rubber latex (Kagetex FA 60%),
2.5% by weight of sulfur vulcanization agent (MC 12 V)
1.7% by weight vulcanization auxiliary agent (Suplon 182 T),
12.7% by weight of chalk (Juraperle MHM),
25.5% by weight of chalk (Calcilit 100, Alpha Fuellstoff, Cologne),
6.8% by weight of filler kaolin (RC 32 K).

The paste, according to example 1, was applied to a jute fabric and further processed.

Example 3

A batch consisting of 3a) 28.00% by weight of tung oil-linseed oil-stand oil (Holzoel-Leinoel-Standoel 90/10),
1.13% by weight of peroxide (Percadox 14-40/K, Akzo Chemie),
1.69% by weight of starch (Spezialstaerke 03430, Maizena company),
1.69% by weight of citric acid,
0.56% by weight of leveling agent (Byk 2600),
9.40% by weight of filler kaolin (RC 32 K),
57.53% by weight of chalk (Juraperle MHM)

was mixed in a planetary stirrer and, according to example 1, was further processed to a grinding stock (intermediate product I). In a second processing step there were first added 3b) 14.4% by weight of crude rubber (14 mm grinding pieces of Rubber SIR 5 L, Kautschukgesellschaft, Frankfurt) fed to a rolling mill heated to 110° C. for formation of raw strip and then
24% by weight of intermediate product I from 3a,
9.6% by weight of wood flour (Technocell FB 120, Cellulose Fuellstoff Fabrik, Moenchengladbach),
43.35% by weight of filler kaolin (RC 32 K),
0.32% by weight of titanium dioxide (RN 57 P Titangesellschaft, Leverkusen),
1.92% by weight of polyethylene (Baylon 23 L 100, Bayer company, Leverkusen),
2.72% by weight of dicumyl peroxide (Luperco 540-CD, Luperox GmbH),
3.69% by weight of peroxide (Luperox P, tertbutylperbenzoate, Luperox GmbH).

After 10 minutes rolling time, 0.65-mm-thick homogeneous raw strip was sheeted-out, which, laid in 4 layers, was pressed to a 2-mm thick sheet in 10 minutes pressing time at 140° C. and 150 bars.

The resulting sheet was flexible and had a hardness of 75 Shore C.

Example 4

A batch consisting of 4a) 28.00% by weight of tung oil-linseed oil-stand oil (Holzoel-Leinoel-Standoel 90/10)
1.13% by weight of peroxide (Percadox 14-40/K, Akzo Chemie),
1.69% by weight of starch (Spezialstaerke 03430, Maizena company),
1.69% by weight of citric acid,
0.56% by weight of leveling agent (Byk 2600),
9.40% by weight of filler kaolin (RC 32 K),
55.73% by weight of chalk (Juraperle MHM)
1.8% by weight of dye (titanium dioxide RN 57 P),
was mixed in a planetary stirrer and, according to example 1, further processed to a grinding stock (intermediate product I). In a second processing step there were first added 4b) 14.9% by weight of crude rubber (Rubber SIR 5) fed to a rolling mill heated to 110° C. for formation of crude strip and then
25% by weight of intermediate product I from 4a),
10% by weight of wood flour (Technocell FB 80),
44.8% by weight of filler kaolin (RC 32 K),
0.3% by weight of dye (titanium dioxide RN 57 P),
2% by weight of polyethylene (Baylon 23 L 100),
3% by weight of vulcanization agent (MC 12 V).

The rolling time was 10 minutes and the temperature 140° C. Then in a short period the vulcanization agent was rolled in. Two of the 1.3-mm-thick crude strips were processed at 140° C. and 150 bars and 5 minutes to a 2-mm thick flexible sheet, whose hardness was 72 Shore C.

Example 5

The process was as in example 4, and instead of vulcanization agent MC 12 V, the peroxide Luperox 130 was used:

5b)
15.1% by weight of natural rubber (Rubber SIR 5 L),
25.2% by weight of intermediate product I from example 4a),
10% by weight of wood flour (Technocell FB 80),
47% by weight of filler kaolin (RC 32 K),
0.35% by weight of dye (titanium dioxide RN 57 P),
2% by weight of polyethylene (Baylon 23 L 100),
0.35% by weight of peroxide ((Luperox 130).

The rolling time was 12 minutes and the temperature was 140° C.

The two crude strips were removed in a thickness of 1.35 mm and pressed for 10 minutes at 140° C. and under 150 bars to a 2-mm thick flexible sheet, whose Shore C hardness was 68.

Example 6

Batch 4a) was processed and crosslinked in the second work cycle with the peroxide Luperox 101, according to example 5. The portion of the peroxide in batch 6b) was 0.35% by weight. The resulting flexible sheet had a Shore C hardness of 63.

Example 7

Prepolymerized batch 4a) was again the basis, which, after adding of the rubber, was further processed:

7b)
14.7% by weight of natural rubber (Rubber SIR 5L)
24.4% by weight of intermediate product I from example 4a),
9.8% by weight of wood flour (Technocell FB 80),
48.8% by weight of filler kaolin (RC 32 K),
1.97% by weight of red dye,
0.33% by weight of peroxide (Luperox 101).

The rolling time was 15 minutes at a temperature of 100° C. Two 1.25-mm thick crude strips were pressed at 140° C. and 150 bars in 10 minutes to a 2-mm-thick flexible sheet with a ShoreC hardness of 78.

Example 8

The following mixture was produced in a planetary mixer:

8a) 28.20% by weight of tung oil-linseed oil-stand oil (Holzoel-Leinoel-Standoel 90/10),
1.13% by weight of peroxide (Percadox 14-40),
1.69% by weight of starch (Spezialstaerke 03430),
1.69% by weight of citric acid,
0.56% by weight of leveling agent (Byk 2600),
9.40% by weight of filler kaolin (RC 32 K),
57.33% by weight of chalk (Juraperle MHM).

The further processing took place on an open continuous mixing and shearing roller extruder (type: COMET CMS 200-1500), which consisted of two rollers provided with grooves. The first roller had 18 grooves with a 1.5-mm depth and 8-mm width at an angle of inclination of 30° and the second roller additionally had two steep grooves with an 8-mm width and a 1-mm depth with 75° steepness and offset 180°.

Each roller had two separately adjustable temperature ranges, and friction and number of rotations of the two rollers were variable.

A cylinder, provided with holes 4 mm in diameter, was hydraulically pressed on the end of the first roller, and the material in the interior of the cylinder pressed through the openings was cut into granular material and was caught by a hopper located under it. The paste was continuously fed into the nip. The processing conditions were:

| | | | | |
|---|---|---|---|---|
| Roller temperatures: | | | | |
| in front | left | 217° C. | right | 217° C. |
| in rear | left | 220° C. | right | 220° C. |
| Nip setting: | | | | |
| left | 3 mm | | | |
| right | 1 mm | | | |

Granular material 8a), thus prepared, was mixed with various colored rubber batches:

8b)
15% by weight of natural rubber (Rubber SIR 5L),
24% by weight of intermediate product I from 8a),
10% by weight of wood flour (Technocell FB 80),
47.65% by weight of filler kaolin (RC 32 K),
1.0% by weight of blue dye,
0.35% by weight of peroxide ((Luperox 101),
2.0% by weight of polyethylene (Baylon 23 L 100), 8c)
15% by weight of natural rubber (Rubber SIR 5L),
24% by weight of intermediate product I from 8a),
10% by weight of wood flour (Technocell FB 80),
47.65% by weight of filler kaolin (RC 32 K),
1.0% by weight of red dye,
0.35% by weight of peroxide ((Luperox 101),
2.0% by weight of polyethylene (Baylon 23 L 100), 8d)
15% by weight of natural rubber (Rubber SIR 5L),
24% by weight of intermediate product I from 8a),
10% by weight of wood flour (Technocell FB 80),
47.65% by weight of filler kaolin (RC 32 K),
1.0% by weight of green dye, 0.35% by weight of peroxide ((Luperox 101), 2.0% by weight of polyethylene (Baylon 23 L 100), Under the following conditions, batches 8b) to 8d) were successively reworked on the shearing rolling mill and granulated.

| | | | | |
|---|---|---|---|---|
| Roller temperatures: | | | | |
| in front | left | 210° C. | right | 110° C. |
| in rear | left | 210° C. | right | 110° C. |
| Nip setting: | | | | |
| left | 0.4 mm | | | |
| right | 1 mm | | | |
| Roller rpm: | | | | |
| in front: | 29.4 | | | |
| in rear: | 22.8 | | | |

The multicolored granular materials were mixed in equal parts by weight and fed to a roller, which had the following process setting:

| | | |
|---|---|---|
| roller temperatures | | 110° C. |
| roller nip | | 0.8 mm |
| speed of rotation | in front 10 m/min | in rear 7 m/min |

As soon as a closed strip was formed, it was removed.

Four 0.7-mm-thick strips were laid on top of one another and compressed under a press; temperature 140° C., pressure 150 bars, pressing time 10 minutes.

A multicolored, longitudinally structured homogeneous covering with a Shore C hardness of 74 was obtained.

Example 9

A prepolymerized batch (intermediate product I) according to example 4a) was compounded as follows on a rolling mill:

9b)

15.4% by weight of natural rubber (Rubber SIR 5L), 25.7% by weight of intermediate product I from example 4a), 10.3% by weight of wood flour (Technocell FB 80), 48.1% by weight of filler kaolin (RC 32 K), 0.2% by weight of red dye, 0.30% by weight of sulfur-containing crosslinking agent (MC 12 V).

The rolling temperature was 140° C., the rolling time before addition of the vulcanization agent was 10 minutes and the pressing conditions were 140° C., 150 bars and 5 minutes pressing time.

The material thus produced is very well suited as floor covering. In comparison with linoleum, the special flexibility, less brittleness and more favorable indentation properties are to be stressed.

The following table shows the most important properties:

TABLE 1

| | | Linoleum (with jute fabric) | Product example 9 (without jute fabric) |
|---|---|---|---|
| Thickness mm | | 3.13 | 2.24 |
| Gross density g/cm$^3$ | | 1.22 | 1.77 |
| Shore A hardness (DIN 53 505) | | 90 | 92.6 |
| Tensile strength N/mm$^2$ | longitudinally | 9 | 4 |
| (DIN 53 571) | crosswise | 4 | 4 |
| Elongation at break % | longitudinally | 8 | 15 |
| (DIN 53 571) | crosswise | 10 | 10 |
| Mandrel flex test | | | |

TABLE 1-continued

| | Linoleum (with jute fabric) | Product example 9 (without jute fabric) |
|---|---|---|
| DIN 51 949 mm break/good | 80/100 | 15/20 |
| Indentation after 150 minutes | | |
| Load mm (DIN 51 955) | 0.66 | 0.17 |
| Indentation after 150 minutes | | |
| Load removal mm (DIN 51 955) | 0.05 | 0.04 |
| Wear test | | |
| (DIN 51 963) Loss of thickness mm | 0.3–0.7 | 0.44 |

Example 10

The polymerization and crosslinking can be controlled by simultaneous use of different peroxides with different decomposition ranges and as a function of the portion of binder and of the vegetable oil/natural rubber ratio in a broad range of flexibilizing and degree of hardness.

A comparison series was made with batch 8a) and crude rubber batch 10b), which was processed with variable binder portions and ratios on the roller and then pressed to sheets. The measured Shore C hardnesses 51 and 83 describe a partial aspect of the possibilities of the process according to the invention.

10b

X% by weight of natural rubber (Rubber SIR 5L)

Y% by weight of intermediate product I from example 8a),

Z% by weight of filler-mixture kaolin/Juraperle,

3% by weight of dye (titanium dioxide RN 57 P)

2% by weight of polyethylene (Baylon 23 L 100)

0.5% by weight of antioxidant (Irganox 1010)

2.89% by weight of peroxide (Luperco S40-CD), 0.38% by weight of peroxide (Luperox P).

(Total=100%)

The processing took place according to example 8. Table 8 reproduces the dependence of the Shore C hardness as a function of the entire binder portion (stand oil=natural rubber) in the finished covering and stand oil/rubber ratio:

TABLE 2

| | Binder Oil + Rubber % by wgt | Portion Stand Oil % by wgt | Portion Natural Rubber % by wgt | Ratio Oil: Rubber | Shore C Hardness |
|---|---|---|---|---|---|
| 1. | 20 | 5 | 15 | 25:75 | 77 |
| 2. | 20 | 10 | 10 | 50:50 | 83 |
| 3. | 20 | 15 | 5 | 75:25 | — |
| 4. | 22 | 15 | 7 | 68:32 | 73 |
| 5. | 25 | 10 | 15 | 40:60 | 77 |
| 6. | 25 | 15 | 10 | 60:40 | 71 |
| 7. | 30 | 10 | 20 | 33:67 | 69 |
| 8. | 30 | 15 | 15 | 50:50 | 65 |
| 9. | 30 | 20 | 10 | 67:33 | 63 |
| 10. | 40 | 10 | 30 | 25:75 | 51 |

Example 11

Intermediate product I was further processed according to example 3a) as follows in a second working step:

11b)

71% by weight of intermediate product I from example 3a),

10% by weight of natural rubber (Rubber SIR 5L),

10% by weight of wood flour (FB 120),
0.3% by weight of filler kaolin (RC 32 K),
3% by weight of dye (titanium dioxide RN 57 P),
2% by weight of polyethylene (Baylon 23 L 100),
0.5% by weight of antioxidant (Irganox 1010),
2.82% by weight of peroxide (Luperco 540-CD 40%),
0.38% by weight of peroxide (Luperox P 98%).

Batch 11b) was processed for 10 minutes at a temperature of 140° C. on a rolling mill. The rolled strip was pressed under a press at 140° C. and 150 bars in 10 minutes to a 2-mm-thick sheet. The Shore C hardness was 69.

Example 12

Intermediate product I was processed according to example 3a) in a second working step with an ethylene-propylene-diene terpolymer (EPDM) as follows:

12a)
25% by weight of intermediate product I from example 3a),
15% by weight of EPDM (Buna AP 437, Huels AG),
10% by weight of wood flour (Technocell FB 120)
41.3% by weight of filler kaolin (RC 32 K),
3% by weight of dye (titanium dioxide RN 57 P),
2% by weight of polyethylene (Baylon 23 L 100),
0.5% by weight of antioxidant (Irganox 1010),
2.82% by weight of peroxide (Luperco 540-CD 40%),
0.38% by weight of peroxide (Luperox P 98%).

Batch 12b) was rolled to a rolled strip in 15 minutes at 110° C. and then pressed to a 2-mm-thick sheet at 140° C. and 150 bars (pressing time 10 minutes). The Shore C hardness was 81.

Example 13

The following mixture was produced in a planetary mixer:

13a)
14.1% by weight of tung oil-linseed oil-stand oil (Holzoel-Leinoel-Standoel 90:10),
14.1% by weight of polymer oil (Polyoel Huels 130, Huels AG, Marl),
1.13% by weight of peroxide (Percadox 14-40 K, 40%),
1.67% by weight of starch (Spezialstaerke 03430),
1.69% by weight of citric acid,
0.56% by weight of leveling agent (Buek 2600),
9.4% by weight of filler kaolin (RC 32 K),
57.35% by weight of chalk (Juraperle MHM)

was mixed according to example 1a). The paste was applied on an endless belt and in a heating channel at 255° C. was crosslinked, cooled, comminuted, ground and screened. Intermediate product I, thus produced, was further processed with crude rubber:

13b)
15% by weight of natural rubber (Rubber SIR 5L),
25% by weight of intermediate product I (13a),
10% by weight of wood flour (Technocell FB 120),
41.3% by weight of filler kaolin (RC 32 K),
3% by weight of dye (titanium dioxide RN 57 P),
2% by weight of polyethylene (Baylon 23 L 100),
0.5% by weight of antioxidant (Irganox 1010),
2.82% by weight of peroxide (Luperco 540-CD),
0.38% by weight of peroxide (Luperox P).

Batch 13b) was processed on a roller in 10 minutes at 110° C. to a crude strip and then pressed at 140° C. and 150 bars in 10 minutes to a 2-mm-thick sheet. The Shore C hardness was 68 to 69.

Example 14

The batch 14a)
28.2% by weight of polymer oil (Polyoel Huels 130),
1.13% by weight of peroxide (Percadox 14-40 K),
1.69% by weight of starch (Spezialstaerke 03430),
1.69% by weight of citric acid,
0.56% by weight of leveling agent (Buek 2600),
9.4% by weight of filler kaolin (RC 32 K),
57.35% by weight of chalk (Juraperle MHM)

was processed according to example 1 to intermediate product I and then further processed with crude rubber according to the following batch:

14b)
15% by weight of natural rubber (Rubber SIR 5L),
25% by weight of intermediate product I (14a),
10% by weight of wood flour (Technocell FB 120),
41.3% by weight of filler kaolin (RC 32 K),
3% by weight of dye (titanium dioxide RN 57 P),
2% by weight of polyethylene (Baylon 23 L 100),
0.5% by weight of antioxidant (Irganox 1010),
2.82% by weight of peroxide (Luperco 540-CD),
0.38% by weight of peroxide (Luperox C).

Batch 14b) was processed on a rolling mill in 10 minutes at 110° C. to a crude strip and then pressed to a 2-mm-thick sheet at 140° C. and 150 bars in 10 minutes. The Shore C hardness was 66 to 67.

The process according to the invention has the advantage in comparison with the linoleum process that it can be used without annealing lasting for weeks at increased temperatures, with short retention times using modern production processes such as mixing, prepolymerizing, rolling, granulating, extruding, precrosslinking, compounding, molding, pressing and crosslinking, and, by use of the natural rubber portion, the crosslinkable unsaturated vegetable oils can be flexibilized or elasticized in any way, while the linoleum crosslinked by air oxidation exhibits a brittle and fragile character.

The production method described in the examples, of course —analogously to the shearing rolling process for continuous production of granular material—can be used on rollers, calenders or also twin belt presses for continuous web fabric production, and the material can be still be embossed before final crosslinking.

We claim:

1. A process for the production of nonwoven materials comprising reacting together in a first reaction phase a mixture containing a) 20 to 40% by weight of ($a_1$) one or more stand oils of a natural oil, and optionally $a_2$) a polymer or synthetic oil with an average molecular weight between 500 and 7000, a dynamic viscosity (20° C.) of greater than 0.5 [Pa.s] and an iodine number (Wijs) greater than 200 [g/100 g].

b) 50 to 75% by weight of fillers and c) a peroxide at a temperature of 200° to 280° C. to produce a partially polymerized and partially crosslinked intermediate product I in the form of a granular material or grinding stock and optionally, in a second reaction phase, adding to the product I binders and additives, and further processing to produce the nonwoven materials.

2. A process according to claim 1, wherein a stand oil obtained from linseed oil or from linseed oil and tung oil of a dynamic viscosity (20° C.) of larger than 10 [Pa.s]

and an iodine number (Wijs) greater than 100 [g/100 g] is used as stand oil.

3. A process according to claim 1, wherein the mixture additionally contains d) 0.1 to 2.6% by weight of wool fat and/or e) 0.1 to 5% by weight of terpenes and/or f) 0.1 to 3% by weight of citric acid.

4. A process according to claim 1, wherein in the second reaction phase a mixture containing a) 5 to 70% by weight of the intermediate produce I b) 5 to 60% by weight of a natural or synthetic elastomer, c) 10 to 70% by weight of filler, d) 0.5 to 7% by weight of one or more crosslinking agents selected from the group consisting of $d_1$) sulfur-containing crosslinking agent, and $d_2$) peroxide is mixed and crosslinked or polymerized at increased temperature.

5. A process according to claim 4, wherein the (partial) crosslinking and (partial) polymerization is performed in the first reaction phase (intermediate product I) and in a second phase with peroxides, and the portion of peroxide in the first reaction phase is 0.1 to 1.5% by weight and in the second reaction phase 0.3 to 7% by weight—respectively relative to the total batch.

6. A process according to claim 4, wherein the total binder portion—relative to the total batch—is between 20 and 40% by weight in an oil/elastomer ratio of 1:3 to 3:1.

7. A process according to claim 1, wherein additionally there are used s intermediate product in the second reaction phase e) 0.1 to 5% by weight of polyolefins and/or f) 0.1 to 2% by weight of acrylates.

8. A process according to claim 4, wherein the first reaction phase takes place in a heating channel, on a rolling mill, in a kneader or on a shearing rolling mil, and the second reaction phase takes place in a heating channel, on a rolling mill, in a kneader, on a shearing rolling mill, in an extruder or in a twin belt press.

9. A process according to claim 4, wherein the first reaction phase occurs at 220° to 260° C. and the second reaction phase takes place at 100° to 220°.

10. A process according to claim 1, wherein in (a) the natural oil is linseed oil, tung oil, soybean oil or a mixture thereof.

11. A process according to claim 7, wherein the polyolefin in (e) is polyethylene.

12. A process according to claim 9, wherein the second reaction phase takes place at 130° to 180°.

* * * * *